US010731955B2

(12) United States Patent
Baum

(10) Patent No.: US 10,731,955 B2
(45) Date of Patent: Aug. 4, 2020

(54) MODULAR GRADIENT-FREE SHAPED CHARGE

(71) Applicant: LAWRENCE LIVERMORE NATIONAL SECURITY, LLC, Livermore, CA (US)

(72) Inventor: Dennis Willard Baum, Danville, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 4 days.

(21) Appl. No.: 15/685,486

(22) Filed: Aug. 24, 2017

(65) Prior Publication Data

US 2018/0299234 A1 Oct. 18, 2018

Related U.S. Application Data

(60) Provisional application No. 62/485,029, filed on Apr. 13, 2017.

(51) Int. Cl.

| | |
|---|---|
| ***F42B 1/028*** | (2006.01) |
| ***F42B 1/032*** | (2006.01) |
| ***F42B 12/18*** | (2006.01) |
| ***F42B 1/036*** | (2006.01) |
| ***E21B 43/117*** | (2006.01) |

(52) U.S. Cl.

CPC ..... *F42B 1/028* (2013.01); *E21B 43/117* (2013.01); *F42B 1/032* (2013.01); *F42B 1/036* (2013.01); *F42B 12/18* (2013.01)

(58) Field of Classification Search

CPC ..... F42B 1/028; F42B 1/032; F42B 1/036; F42B 12/18; E21B 43/117

USPC ..... 102/307

See application file for complete search history.

(56) References Cited

U.S. PATENT DOCUMENTS

| | | | | | |
|---|---|---|---|---|---|
| 2,856,850 | A * | 10/1958 | Church | F42B 1/02 | 102/307 |
| 2,988,994 | A * | 6/1961 | Fleischer, Jr. | F42B 12/10 | 102/306 |
| 3,008,417 | A * | 11/1961 | Keathley | F02K 9/18 | 102/287 |
| 3,176,617 | A * | 4/1965 | Brafford | F42B 5/025 | 102/282 |
| 3,978,796 | A * | 9/1976 | Hackman | F42B 12/14 | 102/476 |
| 4,043,266 | A * | 8/1977 | Held | F42B 1/036 | 102/306 |
| 4,187,782 | A * | 2/1980 | Grace | F42B 1/02 | 102/475 |
| 4,191,265 | A * | 3/1980 | Bosse-Platiere | E21B 43/117 | 102/310 |
| H000362 | H * | 11/1987 | Madderra | 102/476 | |
| 4,798,244 | A * | 1/1989 | Trost | E21B 43/263 | 102/313 |
| 5,007,347 | A * | 4/1991 | Greene | F42B 12/105 | 102/293 |

(Continued)

*Primary Examiner* — Michelle Clement

(74) *Attorney, Agent, or Firm* — Eddie E. Scott

(57) ABSTRACT

A shaped charge produces a constant velocity jet. The shaped charge is comprised of individual modules which can be assembled to produce a constant velocity jet of arbitrary length. The resulting jet speed is approximately twice the detonation velocity and independent of the liner material. The modular design also allows different liner materials to be used sequentially in the same jet.

22 Claims, 7 Drawing Sheets

(56) References Cited

U.S. PATENT DOCUMENTS 5,123,612 A * 6/1992 Labroche ..... F41G 7/222 102/476
5,191,169 A * 3/1993 Hu ..... F42B 12/14 102/476
5,493,973 A * 2/1996 Brion ..... F42B 5/192 102/431
5,565,647 A * 10/1996 Kerdraon ..... F42B 12/18 102/210
5,744,746 A * 4/1998 Tripptrap ..... F42B 12/18 102/211
5,780,766 A * 7/1998 Schroppel ..... F42B 12/16 102/308
5,936,184 A * 8/1999 Majerus ..... F42B 3/08 102/306
6,327,955 B1 * 12/2001 Kerdraon ..... F41H 5/007 89/36.17
6,584,908 B2 * 7/2003 Alford ..... F41B 9/0046 102/302
6,659,013 B1 * 12/2003 Kellner ..... F42B 12/06 102/516
6,672,218 B2 * 1/2004 Oechslin ..... F42B 12/06 102/334
6,840,178 B2 * 1/2005 Collins ..... F42B 1/032 102/307
6,962,202 B2 * 11/2005 Bell ..... E21B 43/116 102/308
7,004,075 B2 * 2/2006 Ronn ..... F42B 12/10 102/473
7,066,093 B2 * 6/2006 Ronn ..... F42B 12/32 102/489
7,231,876 B2 * 6/2007 Kellner ..... F42B 12/204 102/491
7,299,735 B2 * 11/2007 Alford ..... F42B 33/062 86/43
7,493,861 B1 * 2/2009 Walters ..... F42B 12/18 102/308
7,536,956 B2 * 5/2009 Sammons ..... C06B 45/00 102/306
7,641,996 B2 * 1/2010 Imanishi ..... H01M 8/0252 429/523
7,707,940 B2 * 5/2010 Lebacher ..... F42B 5/38 102/432
8,336,461 B2 * 12/2012 Reinmuller ..... F42B 27/00 102/476
8,505,454 B2 * 8/2013 Boyer ..... F42B 1/028 102/306
8,734,960 B1 * 5/2014 Walker ..... F42B 1/028 102/306
8,839,704 B2 * 9/2014 Baum ..... F42D 5/04 86/50
9,074,855 B1 * 7/2015 Frericks ..... F42B 1/02
9,169,695 B1 * 10/2015 Calvert ..... E21B 43/116
9,273,944 B2 * 3/2016 Collier ..... F42B 12/18
9,284,824 B2 * 3/2016 Fadul ..... E21B 43/117
9,303,961 B1 * 4/2016 Frericks ..... F42B 1/028
9,441,924 B1 * 9/2016 Frericks ..... F42B 1/032
9,581,422 B2 * 2/2017 Preiss ..... F42C 19/12
9,612,095 B2 * 4/2017 Smart ..... H05K 999/99
9,982,979 B2 * 5/2018 Graswald ..... F42B 1/02
2003/0167956 A1 * 9/2003 Kellner ..... F42B 12/204 102/517
2004/0211335 A1 * 10/2004 Helander ..... F42B 12/16 102/477
2005/0126420 A1 * 6/2005 Givens ..... F42B 1/02 102/310
2006/0124021 A1 * 6/2006 Urwin ..... F42B 5/16 102/476
2007/0240599 A1 * 10/2007 Pratt ..... E21B 43/117 102/307
2010/0000397 A1 * 1/2010 Pratt ..... E21B 43/117 89/1.15
2010/0018427 A1 * 1/2010 Roland ..... F41H 11/11 102/305
2011/0232519 A1 * 9/2011 Sagebiel ..... F42B 1/028 102/309
2013/0206385 A1 * 8/2013 Feng ..... E21B 43/119 166/55
2014/0060369 A1 * 3/2014 Mclean ..... F42B 1/028 102/310
2014/0230682 A1 * 8/2014 Bonnstetter ..... F42B 12/24 102/492
2015/0376992 A1 * 12/2015 Grattan ..... E21B 43/117 175/4.57
2016/0097620 A1 * 4/2016 Graswald ..... F42B 1/02 102/332
2017/0343329 A1 * 11/2017 Teper ..... F42B 12/46
2018/0274342 A1 * 9/2018 Sites ..... E21B 43/117
2018/0305270 A1 * 10/2018 Lewtas ..... C06B 45/10

* cited by examiner

MODULAR GRADIENT-FREE SHAPED CHARGE

STATEMENT AS TO RIGHTS TO APPLICATIONS MADE UNDER FEDERALLY SPONSORED RESEARCH AND DEVELOPMENT

The present application claims benefit under 35 U.S.C. § 119(e) of United States Provisional Patent Application No. 62/485,029 filed Apr. 13, 2017 the disclosure of which is hereby incorporated by reference in its entirety for all purposes.

The United States Government has rights in this application pursuant to Contract No. DE-AC52-07NA27344 between the United States Department of Energy and Lawrence Livermore National Security, LLC for the operation of Lawrence Livermore National Laboratory.

BACKGROUND

Field of Endeavor

The present disclosure relates to shaped charges and more particularly to a modular gradient-free shaped charge.

State of Technology

This section provides background information related to the present disclosure which is not necessarily prior art.

The simplest configuration for a shaped charge is a right circular cylinder, comprised of an annulus of explosive surrounding a thin-walled metal or other material tube (commonly referred to as the liner). When the explosive is initiated at one end, the progressing detonation will collapse the liner along the axis of the charge. The collapse process progresses along the charge at the same velocity speed as the detonation. An analytic solution exists to describe the progressive collapse of the liner and under certain conditions forms a jet of liner material in the forward direction. The resulting jet from a cylindrical collapse has a speed of twice the detonation speed and no velocity gradient from tip to tail of the jet. This simple relationship between detonation speed and jet speed, which is constant along the entire length of the charge enables the creation of a jet limited in length only by the length of the charge. The length of traditional shaped charge jets can only be increased in length by increasing the diameter as well as the length of the charge. This is a massive penalty as charge weight increases by a factor of 8 to accomplish a doubling of jet length. This invention allows the jet length to be doubled with only a factor of two increase in charge weight.

The use of a cylindrical shaped charge liner is not a new concept; however, its implementation has not been realized because it requires an explosive with detonation speed less than the sound speed of the liner material. For common solid explosives and metal liners, this combination of material properties does not exist. While the theory is not new, the realization is new. This invention enables the sound speed criteria to be met, by using a heavily metal loaded explosive referred to as multiphase blast explosive (MBX) to drive a standard liner material. The particulate loading of the explosive has the effect of reducing the detonation speed below the sound speed of common metals such as copper, steel, aluminum, etc, thus enabling the formation of a stable jet of these liner materials. Note that the particulate loading of the explosive serves to reduce the rate of propagation of the detonation along the axial direction of the charge, while maintaining a relatively high detonation pressure. This combination of reduced effective detonation speed without a corresponding reduction in detonation pressure results in an increased deflection angle of the liner under explosive loading, which serves to increase the diameter of the jet. Note also that it may not be necessary to utilize a high density metal particulate fill in the explosive, as the operative mechanism in MBX is the obstruction of direct forward progression of the detonation. The required obstruction can potentially be obtained by particles of any density, as long as they serve to provide sufficient obstruction to the straightforward detonation propagation.

SUMMARY

Features and advantages of the disclosed apparatus, systems, and methods will become apparent from the following description. Applicant is providing this description, which includes drawings and examples of specific embodiments, to give a broad representation of the apparatus, systems, and methods. Various changes and modifications within the spirit and scope of the application will become apparent to those skilled in the art from this description and by practice of the apparatus, systems, and methods. The scope of the apparatus, systems, and methods is not intended to be limited to the particular forms disclosed and the application covers all modifications, equivalents, and alternatives falling within the spirit and scope of the apparatus, systems, and methods as defined by the claims.

An invention is described which is a shaped charge design which produces a constant velocity jet. The charge design can be comprised of individual modules which can be assembled to produce a constant velocity jet of arbitrary length. The resulting jet speed is approximately twice the detonation velocity and independent of the liner material. The modular design also allows different liner materials to be used sequentially in the same jet.

A constant velocity jet does not undergo the particulation inherent in a stretching jet. Thus, the charge can be used in applications requiring a long standoff distance between the charge and target. Past and current uses of charges designed for gradient free operation are not modular and thus have an inherent limit to jet length, and require large diameters to increase jet length. Military uses include anti-armor and anti-submarine warheads, disablement tool for explosive ordnance disposal, and render safe operations. Non-Military uses include a perforator for use in perforation of well casing. The well can be an oil well, a gas well, a geothermal well, a water well, an injection well, a withdrawal well or other type of well.

The apparatus, systems, and methods are susceptible to modifications and alternative forms. Specific embodiments are shown by way of example. It is to be understood that the apparatus, systems, and methods are not limited to the particular forms disclosed. The apparatus, systems, and methods cover all modifications, equivalents, and alternatives falling within the spirit and scope of the application as defined by the claims.

BRIEF DESCRIPTION OF THE DRAWINGS

The accompanying drawings, which are incorporated into and constitute a part of the specification, illustrate specific embodiments of the apparatus, systems, and methods and, together with the general description given above, and the detailed description of the specific embodiments, serves to explain the principles of the apparatus, systems, and methods.

DETAILED DESCRIPTION OF SPECIFIC EMBODIMENTS

Figure 1:
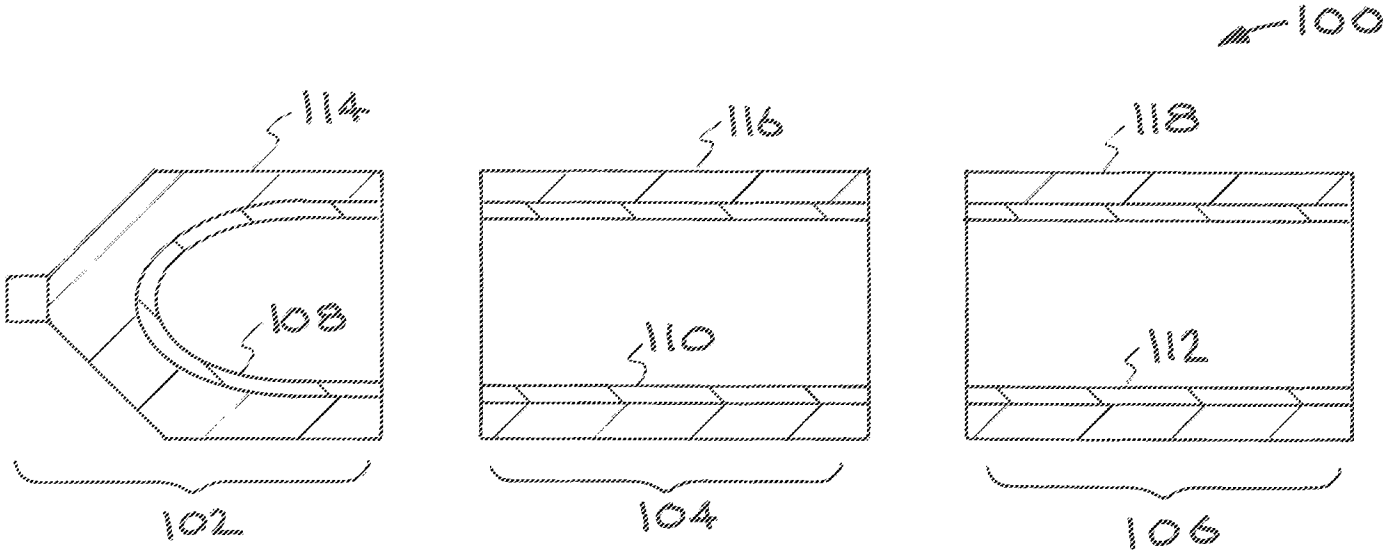
FIG. 1 illustrates one embodiment of the invention wherein a shaped charge produces a constant velocity jet.

Referring to the drawings, to the following detailed description, and to incorporated materials, detailed information about the apparatus, systems, and methods is provided including the description of specific embodiments. The detailed description serves to explain the principles of the apparatus, systems, and methods. The apparatus, systems, and methods are susceptible to modifications and alternative forms. The application is not limited to the particular forms disclosed. The application covers all modifications, equivalents, and alternatives falling within the spirit and scope of the apparatus, systems, and methods as defined by the claims.

The phenomenon of forming a forward traveling jet of material when explosively collapsing a conical or other shaped liner material is well known and has been studied and tested extensively for nearly 100 years. The shape of the liner material is typically a simple geometric configuration such as a cone, hemisphere, flared cone (trumpet), ellipse, for example. The speed of the jet resulting from the progressive collapse of the liner material along the axis of symmetry of the liner is dependent on the detonation speed of the surrounding explosive and the angle at which the collapsing liner impacts the centerline of the charge. The length of the jet is determined and limited by the length of the charge and the rate the jet stretches after formation due to axial velocity gradients in the jet. Increases in jet length are typically gained by increasing the size (length and diameter) of the charge. To gain a factor of two increase in length requires a charge having twice the length and twice the diameter, which then results in a factor of 8 increase in charge weight.

A particularly simple charge configuration which in theory allows longer jets without a corresponding increase in charge diameter is a cylindrical liner, in which charge length can be increased without a corresponding diameter increase. Doubling the length of a cylindrical charge should produce twice the jet length, with no increase in diameter and thus only a factor of two increase in charge weight. The properties of a cylindrical jetting configuration are well known and can be calculated from analytic formulations. However, the formation of a stable, coherent jet requires that the detonation speed of the explosive be less than the local speed of sound in the liner material at the point of collapse, i.e. a stable jet is always formed when the collision process at the axis of the charge is subsonic. This stability criteria is difficult to achieve in practice as detonation speeds for common explosives are typically greater than the sound speed of common liner materials. A stable jet is commonly achieved by utilizing a conic or similar liner wherein the collapse angle of the liner is adjusted to meet the subsonic criterion.

This invention proposes using a cylindrical charge and liner geometry, in conjunction with multiphase blast explosive (MBX) which provides a mechanism for reducing the axial rate of propagation (speed) of the detonation front to a value below that of common liner materials such as copper. This combination of MBX, copper liner, and cylindrical geometry meets the subsonic criterion for stable jet formation and allows a linear increase in jet length with a corresponding linear increase in charge weight. The resulting jet is also a constant velocity jet, no tip to tail velocity gradient, at approximately twice the detonation velocity of the MBX formulation.

The MBX material used for this invention is a uniform mixture of a conventional explosive infiltrated with inert particles. The role of the particles is to disrupt the normal detonation propagation rate by forcing the detonation to propagate around the inert particulates in the mixture. In practice, detonation rates have been reduced to less than 5 km/sec in HMX based explosives, which allows stable jets to form using cylindrical liners of copper or any other material with sound speed less than the MBX detonation velocity. It is also a property of a cylindrical liner that the resulting jet speed is independent of the liner material and thus different liner materials can be incorporated in the same charge, resulting in a jet of sequential materials of different densities.

The cylindrical geometry of this invention allows for the coupling together of multiple modules, each module producing a gradient-free jet at the same speed, thereby producing an arbitrarily long jet. Note that the jet speed is not dependent on the liner material and thus different modules can incorporate different liner materials, producing a jet comprised of sequentially different materials.

A particular configuration of modules can consist of a base unit which serves to initiate the detonation propagation and the formation of a jet. This base unit can be comprised of a conventional explosive driving a conventional simple shaped charge liner configuration, such as a cone or tulip geometry. The base unit is directly coupled to an MGF cylindrical module incorporating MBX, with the shaped liner of the base unit directly aligned with the cylindrical liner of the module and the detonation in the base unit directly shock initiating the MBX. Thus the added modules require no independent initiation system, as they are contact initiated directly from the base unit or prior module. The present application relates to nanowire suspensions and more particularly to fabrication of nanoporous aerogels via freeze substitution of nanowire suspensions.

The modular aspect of this invention allows for in-field assembly of a modular components to adjust the length as well as the material(s) in a continuous jet. The modular aspect also allows for easy portability of a individual modules which can be easily assembled to produce deep penetration. These features are unique to this invention.

Referring now to the drawings and in particular to FIG. 1, one embodiment of Applicant's apparatus, systems, and methods is illustrated. This embodiment is designated generally by the reference numeral 100. The embodiment 100 provides a shaped charge design which produces a constant velocity jet. The charge design is comprised of individual modules which are assembled to produce a constant velocity jet of arbitrary length. The embodiment 100 includes the following components:

base unit—102,
first modular unit—104,
second modular unit—106,
base unit liner material—108
first modular unit liner material—110,
second modular unit liner material—112,
base unit conventional explosive—114,
first modular unit multiphase blast explosive—116, and
second modular unit multiphase blast explosive—118.

The embodiment 100 of the inventor's apparatus, systems, and methods provides a shaped charge design which produces a constant velocity jet. The charge design includes the individual modules: base unit 102, first modular unit 104, and second modular unit 106. The individual modules are assembled to produce a constant velocity jet of a predetermined length. The resulting jet speed is approximately twice the detonation velocity and independent of the liner materials: base unit liner material 108, first modular unit liner material 110, and a second modular unit liner material 112. The modular design also allows different liner materials to be used sequentially in the same jet.

The embodiment 100 utilizes base unit 102 to initiate the detonation propagation and the formation of a jet. The base unit 102 is directly coupled to and aligned with the first modular unit 104 and the second modular unit 106.

The base unit 102 is comprised of a conventional explosive 114 driving a conventional simple shaped charge liner 108 configuration, such as a cone or tulip geometry. The first modular unit 104 incorporates multiphase blast explosive 116 with the first modular unit liner material 110. The second modular unit 106 incorporates multiphase blast explosive 116 with the second modular unit liner material 112.

The embodiment 100 utilizes a cylindrical charge and liner geometry, in conjunction with multiphase blast explosive (MBX) 116 which provides a mechanism for reducing the axial rate of propagation (speed) of the detonation front to a value below that of common liner materials 110/112 such as copper. This combination of MBX, copper liner 110/112, and cylindrical geometry meets the subsonic criterion for stable jet formation and allows a liner increase in jet length with a corresponding liner increase in charge weight. The resulting jet is also a constant velocity jet, no tip to tail velocity gradient, at approximately twice the detonation velocity of the MBX formulation.

The MBX material 116 and 118 used for this invention is a uniform mixture of a conventional explosive infiltrated with inert particles. The role of the particles is to disrupt the normal detonation propagation rate by forcing the detonation to propagate around the inert particulates in the mixture. In practice, detonation rates have been reduced to less than 5 km/sec in HMX based explosives, which allows stable jets to form using cylindrical liners of copper or any other material with sound speed less than the MBX detonation velocity. It is also a property of a cylindrical liner that the resulting jet speed is independent of the liner material and thus different liner materials can be incorporated in the same charge, resulting in a jet of sequential materials of different densities.

The added modules require no independent initiation system, as they are contact initiated directly from the base unit or prior module. The modular aspect of the embodiment 100 allows for in-field assembly of a modular components to adjust the length as well as the material(s) in a continuous jet. The modular aspect also allows for easy portability of individual modules which can be easily assembled to produce deep penetration.

Figure 2:
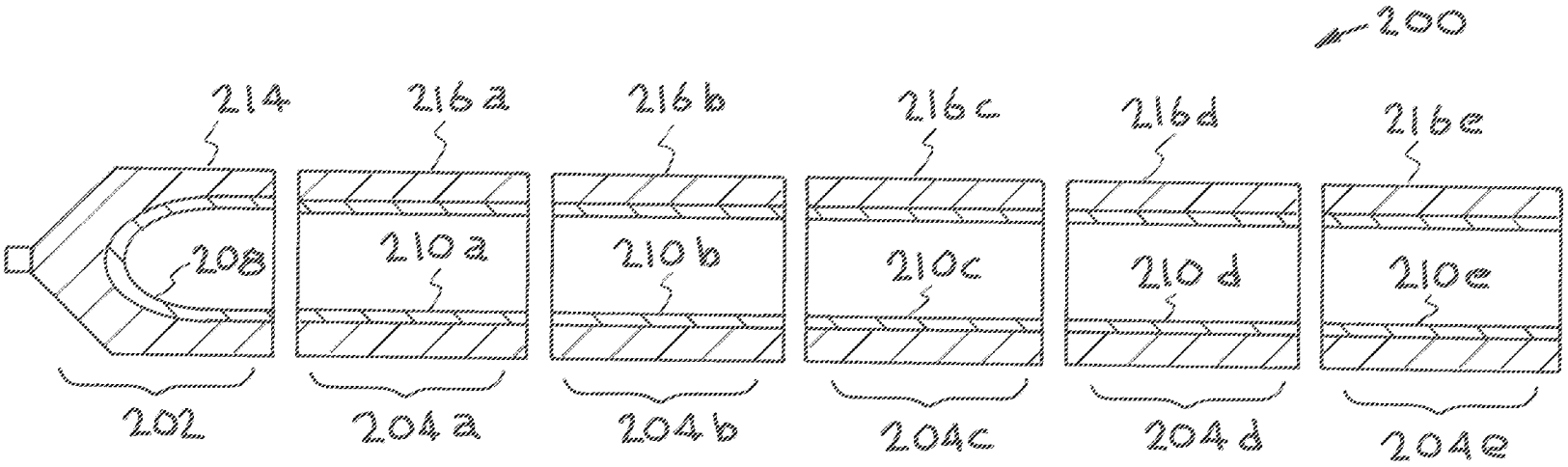
FIG. 2 illustrates another embodiment of the invention wherein a shaped charge produces a constant velocity jet.

Referring now FIG. 2, a second embodiment of Applicant's apparatus, systems, and methods is illustrated. This embodiment is designated generally by the reference numeral 200. The embodiment 200 provides a shaped charge design comprised of a larger number of individual modules. The individual modules are assembled to produce a constant velocity jet of arbitrary length. The embodiment 200 includes the following components:

base unit—202;
modular units—204*a*, 204*b*, 204*c*, 204*d*, and 204*e;*
base unit liner material—208;
modular unit liner materials—210*a*, 210*b*, 210*c*, 210*d*, and 210*e*; and
modular unit multiphase blast explosives—216*a*, 216*b*, 215*c*, 216*d*, and 216*e*.

The embodiment 200 of the inventor's apparatus, systems, and methods provides a shaped charge design which produces a constant velocity jet. The embodiment 200 charge design includes base unit 202 multiple individual modular units 204*a*, 204*b*, 204*c*, 204*d*, and 204*e*. The individual modular units are assembled to produce a constant velocity jet of a predetermined length. The resulting jet speed is approximately twice the detonation velocity and independent of base unit liner material 208 and modular units liner materials 210*a*, 210*b*, 210*c*, 210*d*, and 210*e*. The modular design also allows different liner materials to be used sequentially in the same jet.

The embodiment 200 utilizes base unit 202 to initiate the detonation propagation and the formation of a jet. The base unit 202 is directly coupled to and aligned with the modular units 204*a*, 204*b*, 204*c*, 204*d*, and 204*e*; particularly modular unit multiphase blast explosives 210*a*, 210*b*, 210*c*, 210*d*, and 210*e*.

The base unit 202 is comprised of a conventional explosive 214 driving a conventional simple shaped charge liner 208 configuration, such as a cone or tulip geometry. The modular units 204*a*, 204*b*, 204*c*, 204*d*, and 204*e* incorporate multiphase blast explosives 210*a*, 210*b*, 210*c*, 210*d*, and 210*e* with the units liner materials 210*a*, 210*b*, 210*c*, 210*d*, and 210*e*. The MBX material 210*a*, 210*b*, 210*c*, 210*d*, and 210*e* used for this invention is a uniform mixture of a conventional explosive infiltrated with inert particles. The role of the particles is to disrupt the normal detonation propagation rate by forcing the detonation to propagate around the inert particulates in the mixture. In practice, detonation rates have been reduced to less than 5 km/sec in HMX based explosives, which allows stable jets to form using cylindrical liners of copper or any other material with sound speed less than the MBX detonation velocity. It is also a property of a cylindrical liner that the resulting jet speed is independent of the liner material and thus different liner materials can be incorporated in the same charge, resulting in a jet of sequential materials of different densities.

The added modules require no independent initiation system, as they are contact initiated directly from the base unit or prior module. The modular aspect of the embodiment 200 allows for in-field assembly of a modular components to adjust the length as well as the material(s) in a continuous jet. The modular aspect also allows for easy portability of individual modules which can be easily assembled to produce deep penetration.

Figure 3:
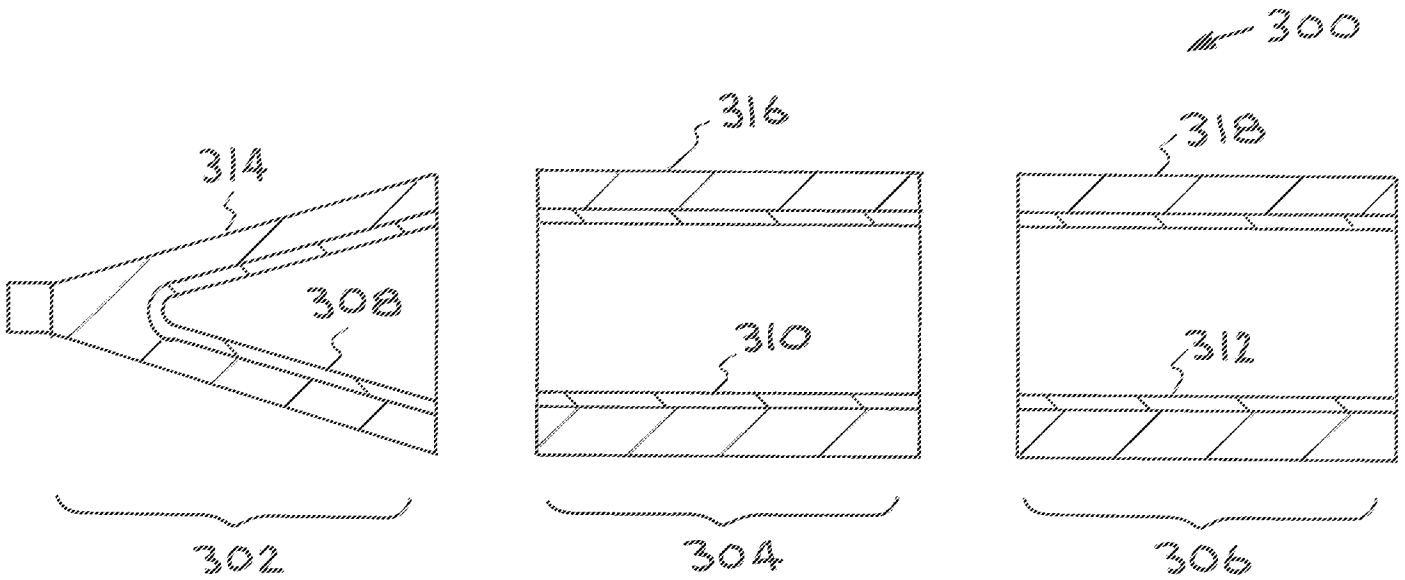
FIG. 3 illustrates another embodiment of the invention wherein the detonator unit has a different shape.

Referring now to FIG. 3, an embodiment of Applicant's apparatus, systems, and methods wherein the detonator unit has a different shape is illustrated. This embodiment is designated generally by the reference numeral 300. The embodiment 300 includes the following components:

base unit—302,
first modular unit—304,
second modular unit—306,
base unit liner material—308
first modular unit liner material—310,
second modular unit liner material—312,
base unit conventional explosive—314,
first modular unit multiphase blast explosive—316, and
second modular unit multiphase blast explosive—318.

The embodiment 300 of the inventor's apparatus, systems, and methods provides a shaped charge design which produces a constant velocity jet. The charge design includes the individual modules: base unit 302, first modular unit 304, and second modular unit 306. The individual modules are assembled to produce a constant velocity jet of a predetermined length. The resulting jet speed is approximately twice the detonation velocity and independent of the liner materials: base unit liner material 308, first modular unit liner material 310, and or second modular unit liner material 312. The modular design also allows different liner materials to be used sequentially in the same jet.

The embodiment 300 utilizes base unit 302 to initiate the detonation propagation and the formation of a jet. The base unit 302 is directly coupled to and aligned with the first modular unit 304 and the second modular unit 306.

The base unit 302 is comprised of a conventional explosive 314 having a conical driving a conventional configuration. The embodiment 300 includes a simple shaped charge liner 308. The first modular unit 304 incorporates multiphase blast explosive 316 with the first modular unit liner material 310. The second modular unit 306 incorporates multiphase blast explosive 316 with the first modular unit liner material 310.

The embodiment 300 utilizes a cylindrical charge and liner geometry, in conjunction with multiphase blast explosive (MBX) 316 which provides a mechanism for reducing the axial rate of propagation (speed) of the detonation front to a value below that of common liner materials 310/312 such as copper. This combination of MBX, copper liner 310/312, and cylindrical geometry meets the subsonic criterion for stable jet formation and allows a liner increase in jet length with a corresponding liner increase in charge weight. The resulting jet is also a constant velocity jet, no tip to tail velocity gradient, at approximately twice the detonation velocity of the MBX formulation.

The MBX material 316/318 used for this invention is a uniform mixture of a conventional explosive infiltrated with inert particles. The role of the particles is to disrupt the normal detonation propagation rate by forcing the detonation to propagate around the inert particulates in the mixture. In practice, detonation rates have been reduced to less than 5 km/sec in HMX based explosives, which allows stable jets to form using cylindrical liners of copper or any other material with sound speed less than the MBX detonation velocity. It is also a property of a cylindrical liner that the resulting jet speed is independent of the liner material and thus different liner materials can be incorporated in the same charge, resulting in a jet of sequential materials of different densities.

The added modules require no independent initiation system, as they are contact initiated directly from the base unit or prior module. The modular aspect of the embodiment 300 allows for in-field assembly of a modular components to adjust the length as well as the material(s) in a continuous jet. The modular aspect also allows for easy portability of individual modules which can be easily assembled to produce deep penetration.

Figure 4A:
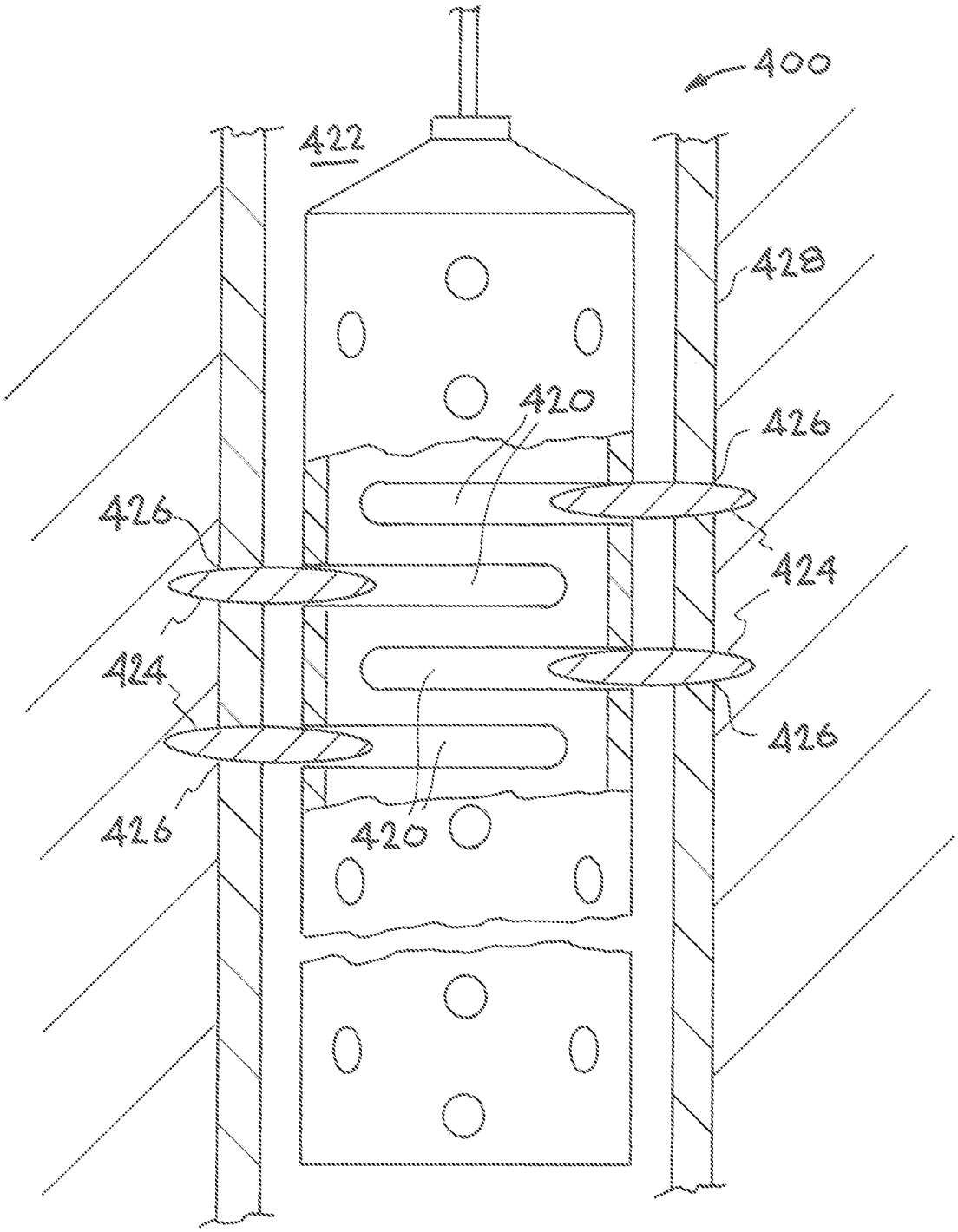
FIGS. 4A and 4B illustrate a perforator for use in perforation of well.
Figure 4B:
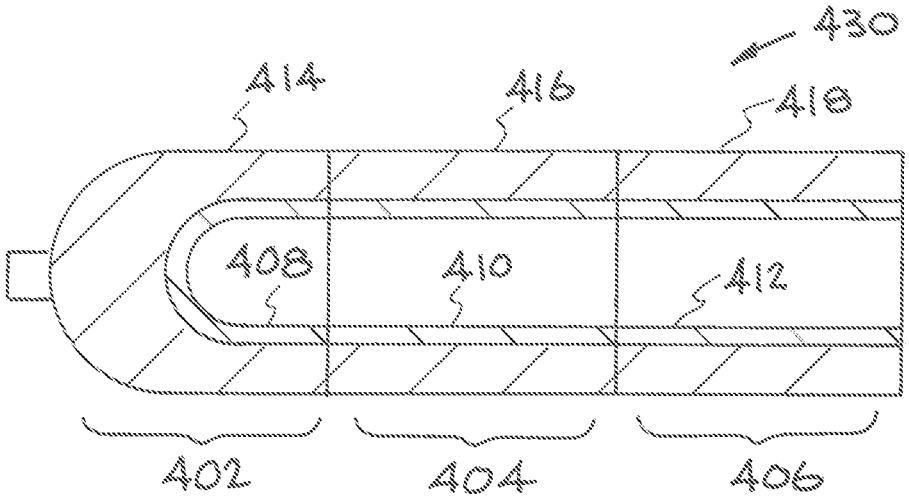

Referring now to FIGS. 4A and 4B, another embodiment of Applicant's apparatus, systems, and methods is illustrated. The embodiment is designated generally by the reference numeral 400. The embodiment 400 provides a perforator 420 for use in perforation of well 422. The well 422 can be an oil well, a gas well, a geothermal well, a water well, an injection well, a withdrawal well or other type of well. The perforator 420 is a shaped charge that produces a jet 424 for punching a hole 426 in the casing or liner 428 of the well 422. The perforator 420 produces a jet 424.

Referring now to FIG. 4A, a multiplicity of shaped charge perforators 420 are used for perforation of well 422. The multiplicity of shaped charge perforators 420 are used to punch holes 426 in the casing or liner 428 of the well 422.

Referring now to FIG. 4B, the shaped charge of the perforator 422 is shown in greater detail. The shaped charge is identified generally by the reference numeral 430. The shaped charge 430 includes the following components:

base unit—402,
first modular unit—404,
second modular unit—406,
base unit liner material—408
first modular unit liner material—410,
second modular unit liner material—412,
base unit conventional explosive—414,
first modular unit multiphase blast explosive—416, and
second modular unit multiphase blast explosive—418.

The shaped charge 430 produces a constant velocity jet. The charge design includes the individual modules: base unit 402, first modular unit 404, and second modular unit 406. The individual modules are assembled to produce a constant velocity jet of a predetermined length. The resulting jet speed is approximately twice the detonation velocity and independent of the liner materials: base unit liner material 408, first modular unit liner material 410, and or second modular unit liner material 412. The modular design also allows different liner materials to be used sequentially in the same jet.

The shape charge 430 utilizes base unit 402 to initiate the detonation propagation and the formation of a jet. The base unit 402 is directly coupled to and aligned with the first modular unit 404 and the second modular unit 406.

The base unit 402 is comprised of a conventional explosive 414 driving a conventional simple shaped charge liner 408 configuration, such as a cone or tulip geometry. The first modular unit 404 incorporates multiphase blast explosive 416 with the first modular unit liner material 410. The second modular unit 406 incorporates multiphase blast explosive 418 with the second modular unit liner material 412.

The shape charge 430 utilizes a cylindrical charge and liner geometry, in conjunction with multiphase blast explosive (MBX) 416/418 which provides a mechanism for reducing the axial rate of propagation (speed) of the detonation front to a value below that of common liner materials 410/412 such as copper. This combination of MBX, copper liner 410/412, and cylindrical geometry meets the subsonic criterion for stable jet formation and allows a liner increase in jet length with a corresponding liner increase in charge weight. The resulting jet is also a constant velocity jet, no tip to tail velocity gradient, at approximately twice the detonation velocity of the MBX formulation.

The MBX material 416 and 418 used for this invention is a uniform mixture of a conventional explosive infiltrated with inert particles. The role of the particles is to disrupt the normal detonation propagation rate by forcing the detonation to propagate around the inert particulates in the mixture. In practice, detonation rates have been reduced to less than 5 km/sec in HMX based explosives, which allows stable jets to form using cylindrical liners of copper or any other material with sound speed less than the MBX detonation velocity. It is also a property of a cylindrical liner that the resulting jet speed is independent of the liner material and thus different liner materials can be incorporated in the same charge, resulting in a jet of sequential materials of different densities.

The added modules require no independent initiation system, as they are contact initiated directly from the base unit or prior module. The modular aspect of the shape charge 430 allows for in-field assembly of a modular components to adjust the length as well as the material(s) in a continuous jet. The modular aspect also allows for easy portability of individual modules which can be easily assembled to produce deep penetration.

Figure 5A:
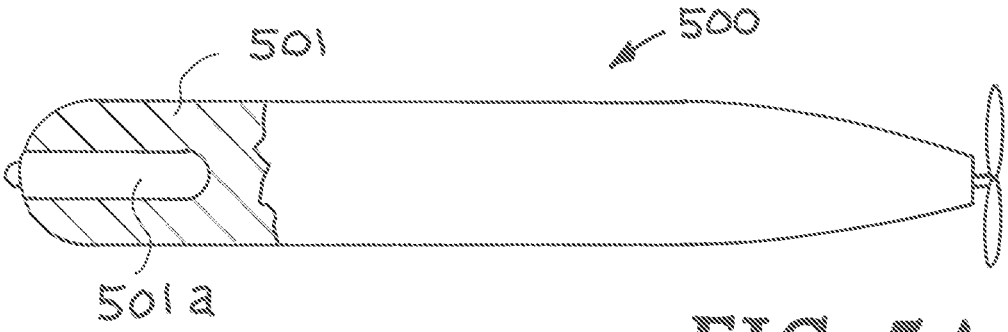
FIGS. 5A and 5B illustrates another embodiment of the invention wherein a torpedo includes a warhead.
Figure 5B:
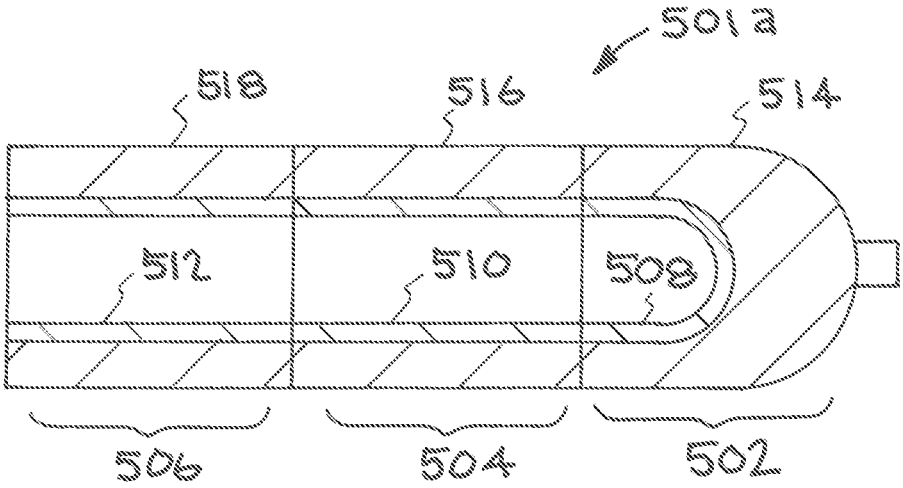

Referring now to FIGS. 5A and 5B, another embodiment of Applicant's apparatus, systems, and methods is illustrated. The embodiment provides a warhead for use in a torpedo.

Referring to FIG. 5A a torpedo 500 includes a warhead 501. The warhead 501 includes a shaped charge 501*a* that produces a jet for punching a hole in an enemy ship or other target.

Referring to FIG. 5B, the shaped charge 501*a* is shown in greater detail. The shaped charge 501*a* includes the following components:

base unit—502,
first modular unit—504,
second modular unit—506,
base unit liner material—508
first modular unit liner material—510,
second modular unit liner material—512,
base unit conventional explosive—514,
first modular unit multiphase blast explosive—516, and
second modular unit multiphase blast explosive—518.

The shaped charge 501*a* produces a constant velocity jet. The charge design includes the individual modules: base unit 502, first modular unit 504, and second modular unit 506. The individual modules are assembled to produce a constant velocity jet of a predetermined length. The resulting jet speed is approximately twice the detonation velocity and independent of the liner materials: base unit liner material 508, first modular unit liner material 510, and or second modular unit liner material 512. The modular design also allows different liner materials to be used sequentially in the same jet.

The shaped charge 501*a* utilizes base unit 502 to initiate the detonation propagation and the formation of a jet. The base unit 502 is directly coupled to and aligned with the first modular unit 504 and the second modular unit 506.

The base unit 502 is comprised of a conventional explosive 514 driving a conventional simple shaped charge liner 508 configuration, such as a cone or tulip geometry. The first modular unit 504 incorporates multiphase blast explosive 516 with the first modular unit liner material 510. The second modular unit 506 incorporates multiphase blast explosive 516 with the second modular unit liner material 512.

The shaped charge 501*a* utilizes a cylindrical charge and liner geometry, in conjunction with multiphase blast explosive (MBX) 516 and 518 which provides a mechanism for reducing the axial rate of propagation (speed) of the detonation front to a value below that of common liner materials 510/512 such as copper. This combination of MBX, copper liner 510/512, and cylindrical geometry meets the subsonic criterion for stable jet formation and allows a liner increase in jet length with a corresponding liner increase in charge weight. The resulting jet is also a constant velocity jet, no tip to tail velocity gradient, at approximately twice the detonation velocity of the MBX formulation.

The MBX material 516 and 518 used for this invention is a uniform mixture of a conventional explosive infiltrated with inert particles. The role of the particles is to disrupt the normal detonation propagation rate by forcing the detonation to propagate around the inert particulates in the mixture. In practice, detonation rates have been reduced to less than 5 km/sec in HMX based explosives, which allows stable jets to form using cylindrical liners of copper or any other material with sound speed less than the MBX detonation velocity. It is also a property of a cylindrical liner that the resulting jet speed is independent of the liner material and thus different liner materials can be incorporated in the same charge, resulting in a jet of sequential materials of different densities.

The added modules require no independent initiation system, as they are contact initiated directly from the base unit or prior module. The modular aspect of the shape charge 501*a* allows for in-field assembly of a modular components to adjust the length as well as the material(s) in a continuous jet. The modular aspect also allows for easy portability of individual modules which can be easily assembled to produce deep penetration.

Figure 6A:
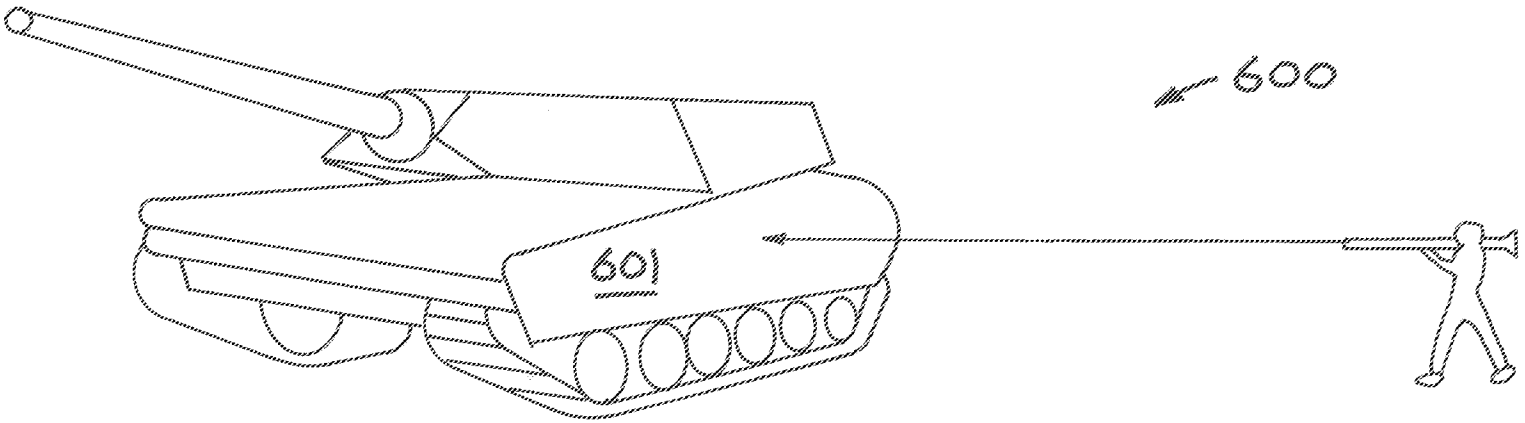
FIGS. 6A and 6B illustrate another embodiment of the invention wherein a shell contains a shaped charge.
Figure 6B:
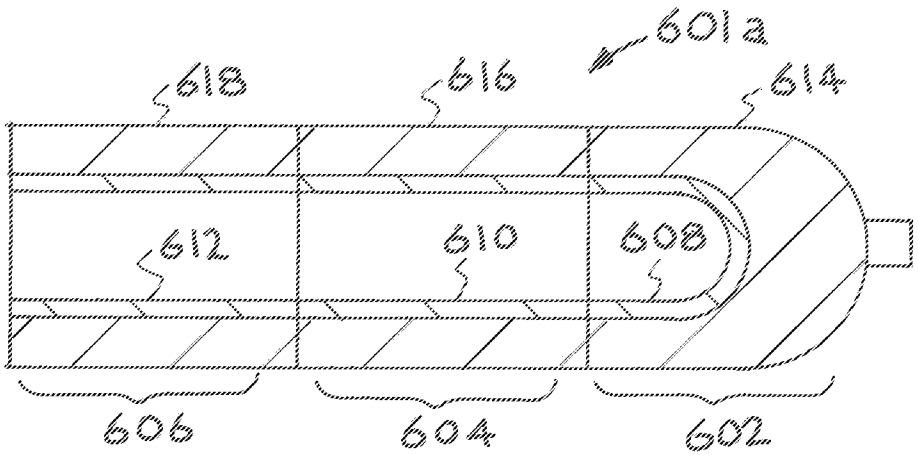

Referring now to FIGS. 6A and 6B, another embodiment of Applicant's apparatus, systems, and methods is illustrated. The embodiment provides a shaped charge for penetrating armor.

Referring to FIG. 6A a shell containing shaped charge 600 is directed onto the armor of tank 601. The shaped charge 600 produces a jet for punching a hole in the armor of tank 601.

Referring to FIG. 6B, the shaped charge 601*a* is shown in greater detail. The shaped charge 601*a* includes the following components:

base unit—602,
first modular unit—604,
second modular unit—606,
base unit liner material—608
first modular unit liner material—610,
second modular unit liner material—612,
base unit conventional explosive—614,
first modular unit multiphase blast explosive—616, and
second modular unit multiphase blast explosive—618.

The shaped charge 601*a* produces a constant velocity jet. The charge design includes the individual modules: base unit 602, first modular unit 604, and second modular unit 606. The individual modules are assembled to produce a constant velocity jet of a predetermined length. The resulting jet speed is approximately twice the detonation velocity and independent of the liner materials: base unit liner material 608, first modular unit liner material 610, and or second modular unit liner material 612. The modular design also allows different liner materials to be used sequentially in the same jet.

The shape charge 601*a* utilizes base unit 602 to initiate the detonation propagation and the formation of a jet. The base unit 602 is directly coupled to and aligned with the first modular unit 604 and the second modular unit 606.

The base unit 602 is comprised of a conventional explosive 614 driving a conventional simple shaped charge liner

608 configuration, such as a cone or tulip geometry. The first modular unit 604 incorporates multiphase blast explosive 616 with the first modular unit liner material 610. The second modular unit 606 incorporates multiphase blast explosive 616 with the second modular unit liner material 612.

The shaped charge 601*a* utilizes a cylindrical charge and liner geometry, in conjunction with multiphase blast explosive (MBX) 616 which provides a mechanism for reducing the axial rate of propagation (speed) of the detonation front to a value below that of common liner materials 610/612 such as copper. This combination of MBX, copper liner 610/612, and cylindrical geometry meets the subsonic criterion for stable jet formation and allows a liner increase in jet length with a corresponding liner increase in charge weight. The resulting jet is also a constant velocity jet, no tip to tail velocity gradient, at approximately twice the detonation velocity of the MBX formulation.

The MBX material 616 and 618 used for this invention is a uniform mixture of a conventional explosive infiltrated with inert particles. The role of the particles is to disrupt the normal detonation propagation rate by forcing the detonation to propagate around the inert particulates in the mixture. In practice, detonation rates have been reduced to less than 5 km/sec in HMX based explosives, which allows stable jets to form using cylindrical liners of copper or any other material with sound speed less than the MBX detonation velocity. It is also a property of a cylindrical liner that the resulting jet speed is independent of the liner material and thus different liner materials can be incorporated in the same charge, resulting in a jet of sequential materials of different densities.

The added modules require no independent initiation system, as they are contact initiated directly from the base unit or prior module. The modular aspect of the shape charge 601*a* allows for in-field assembly of a modular components to adjust the length as well as the material(s) in a continuous jet. The modular aspect also allows for easy portability of individual modules which can be easily assembled to produce deep penetration.

Figure 7:
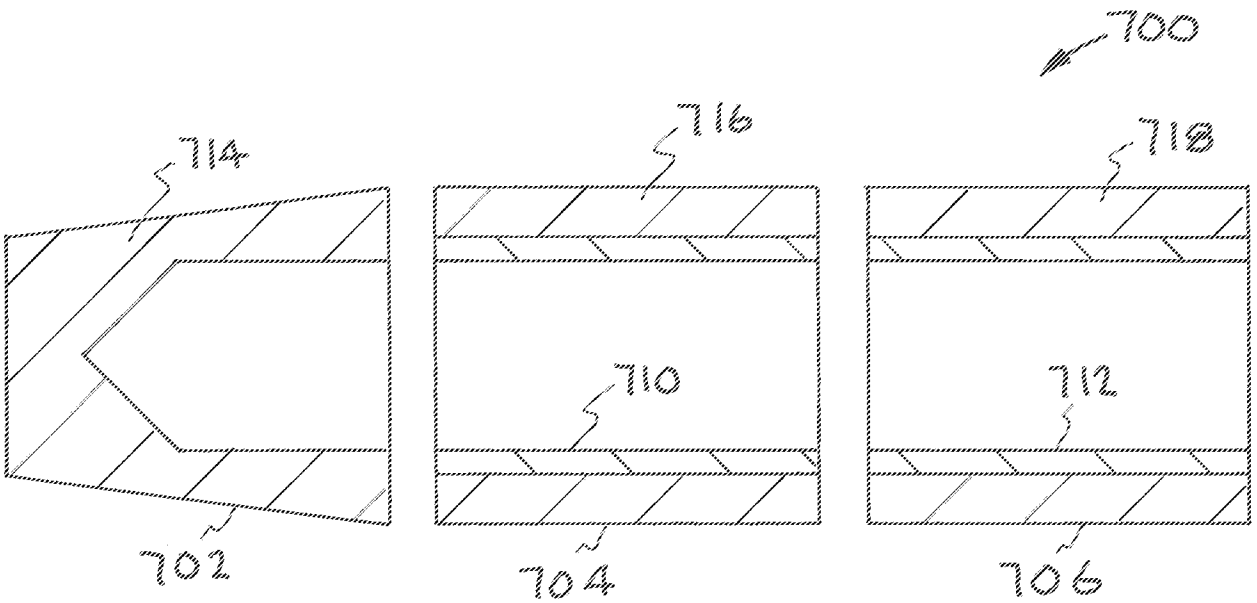
FIG. 7 illustrates another embodiment of the invention wherein a shaped charge produces a constant velocity jet and demonstrates that the base unit (detonator) does not require a liner.

Referring now to FIG. 7, another embodiment of Applicant's apparatus, systems, and methods is illustrated. This embodiment is designated generally by the reference numeral 700. The embodiment 700 demonstrates that the base unit (detonator) does not require a liner. The embodiment 700 includes the following components:

base unit—702,
first modular unit—704,
second modular unit—706,
first modular unit liner material—710,
second modular unit liner material—712,
base unit conventional explosive—714,
first modular unit multiphase blast explosive—716, and
second modular unit multiphase blast explosive—718.

The embodiment 700 of the inventor's apparatus, systems, and methods provides a shaped charge design which produces a constant velocity jet. The charge design includes the individual modules: base unit (detonator) 702, first modular unit 704, and second modular unit 706. The individual modules are assembled to produce a constant velocity jet of a predetermined length. The embodiment 700 utilizes base unit (detonator) 702 to initiate the detonation propagation and the formation of the jet. The base unit (detonator) 702 is directly coupled to and aligned with the first modular unit 704 and the second modular unit 706.

The base unit 702 is comprised of a conventional explosive 714, such as a cone or tulip geometry. The first modular unit 704 incorporates multiphase blast explosive 716 with the first modular unit liner material 710. The second modular unit 706 incorporates multiphase blast explosive 716 with the first modular unit liner material 710. The added modules require no independent initiation system, as they are contact initiated directly from the base unit or prior module. The modular aspect of the embodiment 700 allows for in-field assembly of a modular components to adjust the length as well as the material(s) in a continuous jet. The modular aspect also allows for easy portability of individual modules which can be easily assembled to produce deep penetration.

Although the description above contains many details and specifics, these should not be construed as limiting the scope of the application but as merely providing illustrations of some of the presently preferred embodiments of the apparatus, systems, and methods. Other implementations, enhancements and variations can be made based on what is described and illustrated in this patent document. The features of the embodiments described herein may be combined in all possible combinations of methods, apparatus, modules, systems, and computer program products. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments.

Therefore, it will be appreciated that the scope of the present application fully encompasses other embodiments which may become obvious to those skilled in the art. In the claims, reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present apparatus, systems, and methods, for it to be encompassed by the present claims. Furthermore, no element or component in the present disclosure is intended to be dedicated to the public regardless of whether the element or component is explicitly recited in the claims. No claim element herein is to be construed under the provisions of 35 U.S.C. 112, sixth paragraph, unless the element is expressly recited using the phrase "means for."

While the apparatus, systems, and methods may be susceptible to various modifications and alternative forms, specific embodiments have been shown by way of example in the drawings and have been described in detail herein. However, it should be understood that the application is not intended to be limited to the particular forms disclosed.

Rather, the application is to cover all modifications, equivalents, and alternatives falling within the spirit and scope of the application as defined by the following appended claims.

The invention claimed is:

1. A shaped charge apparatus that produces a jet, comprising:

a detonator base unit, said detonator base unit including a conventional explosive;

a first modular unit including a first modular unit liner material and a first modular unit multiphase blast explosive surrounding said first modular liner material, wherein said first modular liner material has a first modular liner material propagation speed, wherein said first modular unit multiphase blast explosive is a mixture of first modular unit conventional explosive infiltrated with first modular unit inert particles, wherein said first modular unit inert particles are inert particles that are positioned in said first modular unit conventional explosive in a role that provides said first modular unit multiphase blast explosive with a first modular unit multiphase blast explosive propagation speed below said first modular liner material propagation speed, wherein said first modular unit conventional explosive produces a detonation, and wherein said first modular unit inert particles are positioned in said first modular unit conventional explosive in a role that disrupts said detonation by forcing said detonation to propagate around said inert particulates to produce said first modular unit multiphase blast explosive propagation speed below said first modular liner material propagation speed; and at least one additional modular unit including additional modular unit liner material and additional modular unit multiphase blast explosive surrounding said second modular liner material, wherein said additional modular liner material has an additional modular liner material propagation speed, wherein said additional modular unit multiphase blast explosive is a mixture of additional modular unit conventional explosive infiltrated with additional modular unit inert particles, wherein said additional modular unit inert particles are inert particles that are positioned in said additional modular unit conventional explosive in a role that provides said additional modular unit multiphase blast explosive with an additional modular unit multiphase blast explosive propagation speed below said additional modular liner material propagation speed, wherein said additional modular unit conventional explosive produces a detonation, and wherein said additional modular unit inert particles are positioned in said additional modular unit conventional explosive in a role that disrupts said detonation by forcing said detonation to propagate around said inert particulates to produce said additional modular unit multiphase blast explosive propagation speed below said additional modular liner material propagation speed;

wherein, said detonator base unit, said first modular unit, and said additional modular unit are assembled to produce the shaped charge apparatus that produces the explosive jet.

2. The shaped charge apparatus of claim 1 wherein said first modular unit inert particles are inert particles that are positioned in said first modular unit conventional explosive in a role that provides said first modular unit multiphase blast explosive with a first modular unit multiphase blast explosive propagation speed below said first modular liner material propagation speed and wherein said first modular unit multiphase blast explosive propagation speed is below the propagation speed of copper.

3. The shaped charge apparatus of claim 1 wherein said first modular unit liner material is made of copper and wherein said first modular unit inert particles are positioned in said first modular unit conventional explosive in a role that disrupts said detonation by forcing said detonation to propagate around said inert particulates to produce said first modular unit multiphase blast explosive propagation speed below said first modular liner material propagation speed and wherein said first modular unit multiphase blast explosive propagation speed is below the propagation speed of copper.

4. The shaped charge apparatus of claim 1 wherein said first modular unit liner material and said second modular unit liner material are aligned.

5. The shaped charge apparatus of claim 1 wherein said first modular unit multiphase blast explosive is a uniform mixture of first modular unit conventional explosive infiltrated with said first modular unit inert particles.

6. The shaped charge apparatus of claim 1 wherein said additional modular unit multiphase blast explosive is a uniform mixture of second modular unit conventional explosive infiltrated with said additional modular unit inert particles.

7. The shaped charge apparatus of claim 1 wherein said first modular unit inert particles and said additional modular unit inert particles are inert particles that produce a detonation rate less than 5 km/sec.

8. An apparatus that produces a jet for penetrating the casing of a well, comprising:

a perforator, a detonator base unit in said perforator, said detonator base unit including a conventional explosive;

a first modular unit in said perforator including a first modular unit liner material and a first modular unit multiphase blast explosive surrounding said first modular liner material, wherein said first modular liner material has a first modular liner material propagation speed, wherein said first modular unit multiphase blast explosive is a mixture of first modular unit conventional explosive infiltrated with first modular unit inert particles, wherein said first modular unit inert particles are inert particles that provide are positioned in said first modular unit conventional explosive in a role that provides said first modular unit multiphase blast explosive with a first modular unit multiphase blast explosive propagation speed below said first modular liner material propagation speed, wherein said first modular unit conventional explosive produces a detonation wherein said first modular unit inert particles are inert particles that provide said first modular unit multiphase blast explosive with a first modular unit multiphase blast explosive propagation speed below said first modular liner material propagation speed, and wherein said first modular unit inert particles are positioned in said first modular unit conventional explosive in a role that disrupts said detonation by forcing said detonation to propagate around said inert particulates to produce said first modular unit multiphase blast explosive propagation speed below said first modular liner material propagation speed; and a second modular unit in said perforator including a second modular unit liner material and a second modular unit multiphase blast explosive surrounding said second modular liner material, wherein said second modular liner material has a second modular liner material propagation speed, wherein said second modular unit multiphase blast explosive is a mixture of second modular unit conventional explosive infiltrated with second modular unit inert particles, wherein said second modular unit inert particles are inert particles that are positioned in said second modular unit conventional explosive in a role that provides said second modular unit multiphase blast explosive with a second modular unit multiphase blast explosive propagation speed below said second modular liner material propagation speed, wherein said second modular unit conventional explosive produces a detonation, and wherein said second modular unit inert particles are positioned in said second modular unit conventional explosive in a role that disrupts said detonation by forcing said detonation to propagate around said inert particulates to produce said second modular unit multiphase blast explosive propagation speed below said second modular liner material propagation speed;

wherein, said detonator base unit, said first modular unit, and said second modular unit are assembled to produce the explosive jet for penetrating the casing of a well.

9. The apparatus that produces a jet for penetrating the casing of a well of claim 8 wherein said first modular unit liner material and said second modular unit liner material are aligned.

10. The apparatus that produces a jet for penetrating the casing of a well of claim 8 wherein said first modular unit multiphase blast explosive is a uniform mixture of conventional explosive infiltrated with said inert particles.

11. The apparatus that produces a jet for penetrating the casing of a well of claim 8 further comprising at least one additional modular unit.

12. A torpedo apparatus that includes a warhead that produces a jet for penetrating a vessel, comprising:

an explosive unit in the warhead, a detonator base unit in said explosive unit, said detonator base unit including a conventional explosive;

a first modular unit in said explosive unit including a first modular unit liner material and a first modular unit multiphase blast explosive surrounding said first modular liner material, wherein said first modular liner material has a first modular liner material propagation speed, wherein said first modular unit multiphase blast explosive is a mixture of first modular unit conventional explosive infiltrated with first modular unit inert particles, wherein said first modular unit inert particles are inert particles that are positioned in said first modular unit conventional explosive in a role that provides said first modular unit multiphase blast explosive with a first modular unit multiphase blast explosive propagation speed below said first modular liner material propagation speed, wherein said first modular unit conventional explosive produces a detonation, and wherein said first modular unit inert particles disrupts said detonation by forcing said detonation to propagate around said inert particulates to produce said first modular unit multiphase blast explosive propagation speed below said first modular liner material propagation speed; and a second modular unit in said explosive unit including a second modular unit liner material and a second modular unit multiphase blast explosive surrounding said second modular liner material, wherein said second modular liner material has a second modular liner material propagation speed, wherein said second modular unit multiphase blast explosive is a mixture of second modular unit conventional explosive infiltrated with second modular unit inert particles, wherein said second modular unit inert particles are inert particles that provide said second modular unit multiphase blast explosive with a second modular unit multiphase blast explosive propagation speed below said second modular liner material propagation speed wherein said second modular unit conventional explosive produces a detonation, and wherein said second modular unit inert particles are positioned in said first modular unit conventional explosive in a role that disrupts said detonation by forcing said detonation to propagate around said inert particulates to produce said second modular unit multiphase blast explosive propagation speed below said second modular liner material propagation speed;

wherein, said detonator base unit, said first modular unit, and said second modular unit are assembled to produce the explosive jet for penetrating the vessel.

13. The torpedo apparatus of claim 12 further comprising at least one additional modular unit.

14. The torpedo apparatus of claim 13 wherein said first modular unit liner material, said second modular unit liner material, and said additional modular unit liner material are aligned.

15. An apparatus that includes a shell that produces a jet for penetrating armor, comprising:

an explosive unit in the shell, a detonator base unit in said explosive unit, said detonator base unit including a conventional explosive;

a first modular unit in said explosive unit including a first modular unit liner material and a first modular unit multiphase blast explosive surrounding said first modular liner material, wherein said first modular liner material has a first modular liner material propagation speed, wherein said first modular unit multiphase blast explosive is a mixture of first modular unit conventional explosive infiltrated with first modular unit inert particles, wherein said first modular unit inert particles are inert particles that are positioned in said first modular unit conventional explosive in a role that provides said first modular unit multiphase blast explosive with a first modular unit multiphase blast explosive propagation speed below said first modular liner material propagation speed, wherein said first modular unit conventional explosive produces a detonation, and wherein said first modular unit inert particles are positioned in said first modular unit conventional explosive in a role that disrupts said detonation by forcing said detonation to propagate around said inert particulates to produce said first modular unit multiphase blast explosive propagation speed below said first modular liner material propagation speed; and a second modular unit in said explosive unit including a second modular unit liner material and a second modular unit multiphase blast explosive surrounding said second modular liner material, wherein said second modular liner material has a second modular liner material propagation speed, wherein said second modular unit multiphase blast explosive is a mixture of second modular unit conventional explosive infiltrated with second modular unit inert particles, wherein said second modular unit inert particles are inert particles that are positioned in said second modular unit conventional explosive in a role that provides said second modular unit multiphase blast explosive with a second modular unit multiphase blast explosive propagation speed below said second modular liner material propagation speed, wherein said second modular unit conventional explosive produces a detonation, and wherein said second modular unit inert particles are positioned in said second modular unit conventional explosive in a role that disrupts said detonation by forcing said detonation to propagate around said inert particulates to produce said second modular unit multiphase blast explosive propagation speed below said second modular liner material propagation speed;

wherein, said detonator base unit, said first modular unit, and said second modular unit are assembled to produce the explosive jet for penetrating the armor.

16. The apparatus that includes a shell that produces a jet for penetrating armor of claim 15 further comprising at least one additional modular unit.

17. The apparatus that includes a shell that produces a jet for penetrating armor of claim 16 wherein said first modular unit liner material and said second modular unit liner material and said additional modular unit liner material are aligned.

18. A method of making a shaped charge that produces a jet, comprising the steps of:

providing a detonator base unit, a detonator base unit, said detonator base unit including a conventional explosive;

providing a first modular unit including a first modular unit liner material and a first modular unit multiphase blast explosive surrounding said first modular liner material wherein said first modular unit multiphase blast explosive is a mixture of first modular unit conventional explosive infiltrated with first modular unit inert particles, wherein said first modular liner material has a first modular liner material propagation speed, wherein said first modular unit inert particles are inert particles that are positioned in said first modular unit conventional explosive in a role that provides said first modular unit multiphase blast explosive with a first modular unit multiphase blast explosive propagation speed below said first modular liner material propagation speed, wherein said first modular unit conventional explosive produces a detonation, and wherein said first modular unit inert particles are positioned in said first modular unit conventional explosive in a role that disrupts said detonation by forcing said detonation to propagate around said inert particulates to produce said first modular unit multiphase blast explosive propagation speed below said first modular liner material propagation speed; and providing a second modular unit including a second modular unit liner material and a second modular unit multiphase blast explosive surrounding said second modular liner material, wherein said first modular liner material has a first modular liner material propagation speed, wherein said second modular unit multiphase blast explosive is a mixture of second modular unit conventional explosive infiltrated with second modular unit inert particles, wherein said second modular unit inert particles are inert particles that are positioned in said second modular unit conventional explosive in a role that provides said second modular unit multiphase blast explosive with a second modular unit multiphase blast explosive propagation speed below said second modular liner material propagation speed, wherein said second modular unit conventional explosive produces a detonation, and wherein said second modular unit inert particles are positioned in said second modular unit conventional explosive in a role that disrupts said detonation by forcing said detonation to propagate around said inert particulates to produce said second modular unit multiphase blast explosive propagation speed below said second modular liner material propagation speed;

wherein, said detonator base unit, said first modular unit, and said second modular unit are assembled to produce the explosive jet.

19. The method of making a shaped charge that produces a jet of claim 18 wherein said first modular unit multiphase blast explosive is a mixture of conventional explosive and inert particles.

20. The method of making a shaped charge that produces a jet of claim 18 wherein said second modular unit multiphase blast explosive is a uniform mixture of conventional explosive and inert particles.

21. The method of making a shaped charge that produces a jet of claim 18 further comprising at least one additional modular unit.

22. The method of making a shaped charge that produces a jet of claim 21 wherein said first modular unit liner material, said second modular unit liner material, and said additional modular unit liner material are aligned.

* * * * *